United States Patent [19]

Hughes et al.

[11] Patent Number: 4,931,610

[45] Date of Patent: Jun. 5, 1990

[54] INDUCTION HEATED ROTARY KILN

[76] Inventors: William L. Hughes, 6118 Greenleaf Ct., Rapid City, S. Dak. 57702; Harold J. Manning, 9106 Maple Dr., Pasco, Wash. 99301

[21] Appl. No.: 363,468

[22] Filed: Jun. 8, 1989

[51] Int. Cl.[5] ..... H05B 6/22

[52] U.S. Cl. ..... 219/10.491; 219/10.67; 219/10.79; 373/138; 373/164

[58] Field of Search ..... 219/10.491, 10.67, 10.69, 219/10.73, 10.79, 10.75, 10.65; 373/143, 138, 146, 155, 156, 157, 162, 164; 432/124, 264

[56] References Cited

U.S. PATENT DOCUMENTS

| | | | |
|---|---|---|---|
| 2,729,556 | 1/1956 | Fontana | 219/10.491 |
| 2,743,306 | 4/1956 | Mark, Jr. | 219/10.491 |
| 2,912,553 | 11/1959 | Tudbury | 219/10.67 |
| 3,361,864 | 1/1968 | Vollmer et al. | 219/10.491 |
| 3,551,115 | 12/1970 | Jamieson et al. | 219/10.491 |
| 3,860,737 | 1/1975 | Moscatello | 219/10.491 |
| 4,039,794 | 8/1977 | Kasper | 219/10.491 |
| 4,070,542 | 1/1978 | Miles et al. | 219/10.491 |

*Primary Examiner*—Philip H. Leung
*Attorney, Agent, or Firm*—Head & Johnson

[57] ABSTRACT

An improved rotary kiln having an elongated kiln member formed of refractory material and supported for rotation, a tubular liner in the kiln member formed of electrically conductive material, a stationary tubular structural non-electrically conductive member concentrically surrounding the kiln and of interior diameter greater than the exterior diameter of the kiln providing an annular space therebetween, an induction coil wound on the exterior of the tubular structural member and an AC source connected to the induction coil and means of rotating the kiln member, the induction coil heating the tubular liner to heat contents within the kiln as the contents are tumbled by rotation of the kiln.

6 Claims, 1 Drawing Sheet

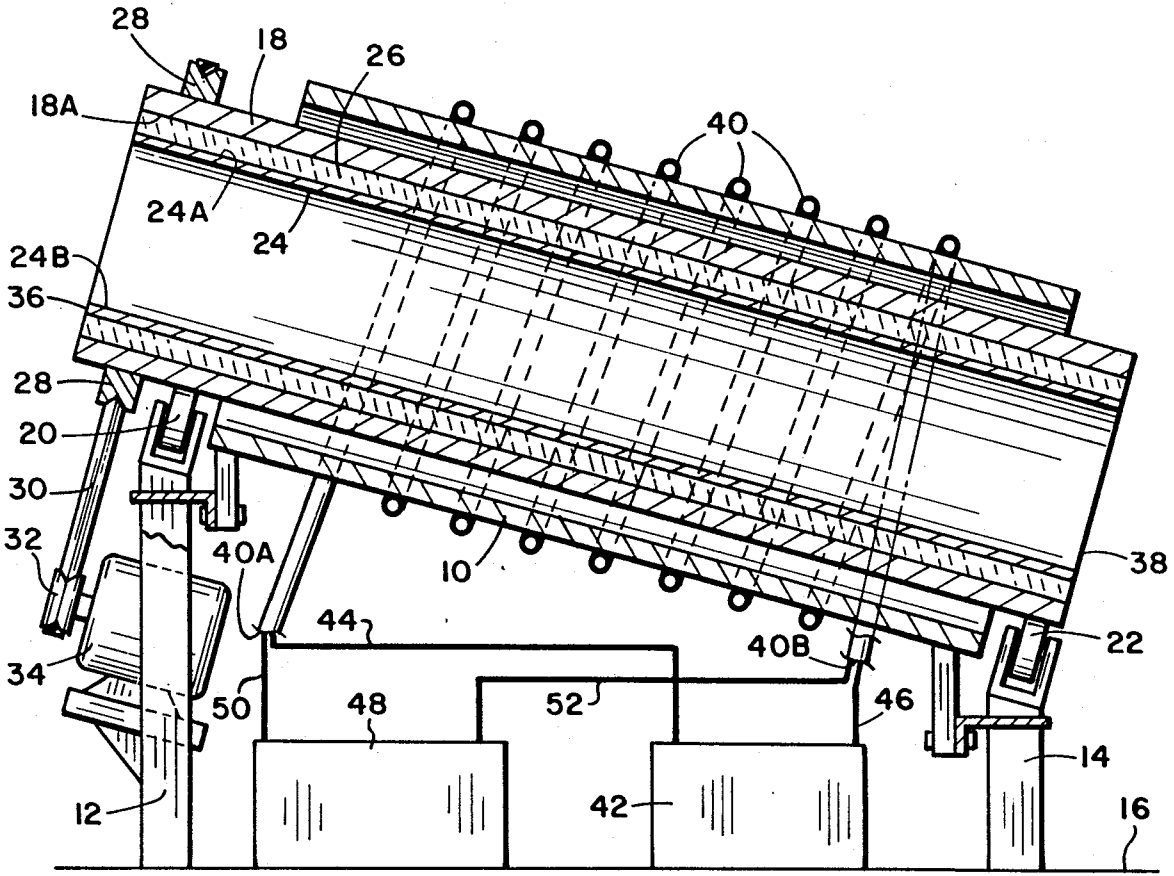
38
22
16
14
46
40B
40
42
52
10
26
48
44
18
24
40A
50
28
24A
12
18A
24B
36
28
20
30
32
34

INDUCTION HEATED ROTARY KILN

SUMMARY OF THE INVENTION

Rotary kilns have long been used to create an environment for high temperature reactions of the contents of the kiln while the contents are tumbled. Rotary kilns are commercially used such as in the manufacture of portland cement, lime, etc. The typical kiln in present commercial use consists of a rotating tube, mounted on an incline. The tube is generally lined with a refractory material. The kiln is typically heated by the injection of hot burning gases or other fuels into the interior of the kiln. This method of heating functions satisfactorily for applications, such as for making portland cement, lime and so forth, but it is a serious problem in other instances. One problem is that the burning fuel sometimes contaminates or alters the desired reaction.

Typically, in the existing type of kilns, the reacting materials are injected in the top of the kiln and are carried through the hot reaction zone by tumbling through the kiln as it rotates while the heating fluid is injected into the lower end or bottom of the kiln.

The present invention is directed to an improved rotary kiln which eliminates the requirement of injecting fuel into the interior of the kiln. By this change in the method of heating a kiln, several advantages are achieved. First, the temperature of the kiln can be more accurately controlled throughout the length of the kiln; and second, the desired chemical reaction of the contents within the kiln are not contaminated by burning fuel.

In the present disclosure, the improved rotating kiln is formed by an elongated tubular kiln member formed of refractory material, or, that is, heat resistive and not electrically conductive material; and supported for rotation. Positioned within the tubular kiln member is a tubular liner formed of electrically conductive material. Such liner may be of steel, steel alloy, conductive ceramic material, and so forth.

A stationary tubular structural non-electrically conductive member is supported concentrically surrounding the kiln member and of interior diameter greater than the exterior diameter of the kiln member providing an annular space therebetween. Whereas the structural member is nonrotatably supported, the kiln member is supported for rotation.

An induction coil is wound on the exterior of the structural member. In the preferred arrangement, the induction coil is formed of a conductive tubular material, such as a copper tube, with water flowing therethrough to act to cool the conductor.

AC electrical energy is applied to the induction coil to cause the tubular liner to be heated. A motor is used to rotate the kiln.

By the arrangement of the kiln which will be hereinafter described in detail, chemical reaction taking place within the kiln are not altered by contact with fuel nor the products of combustion of fuel. Further, the temperature within the interior of the kiln can be more carefully controlled, and if necessary the kiln can be filled with inert gas so as to even further prevent contamination or alteration of the chemical reaction.

For background information relating to kilns and their method of use, reference may be had to the following U.S. patents which were found in a search conducted in Class 373, subclasses 148, 151, 119, 134, 125, 137 and 138, and in class 432 subclasses 120, 122, 124 and class 219 subclasses 244, 239, 406, 420, 424, 427 and 503: U.S. Pat. Nos. 3,474,178; 3,377,417; 4,241,232; 2,768,226; 4,639,931; 4,688,231; 2,957,064; 1,749,700.

An additional advantage of the apparatus of this invention is that the temperature of the chemical reaction can be more accurately controlled from one area to another through the length of the kiln.

The invention will be better understood with reference to the following description and claims, taken in conjunction with the attached drawing.

DESCRIPTION OF THE DRAWING

The drawing is a diagrammatic cross-sectional elevational view of a kiln employing the principles of this invention.

DETAILED DESCRIPTION OF THE PREFERRED EMBODIMENT

Referring to the drawing, an elevational, cross-sectional, diagrammatic view is shown of the improved rotating kiln. A stationary tubular non-electrically conductive structural member 10 is supported such as by means of posts 12 and 14. The member 10 is supported so that the tubular axis is inclined at an acute angle relative to the horizontal support surface 16.

Concentrically received within the tubular structure 10 is a kiln member 18 which is preferably constructed of a non-electrically conductive material such as a refractory material which may be made of the same material are commercially available transite pipe. The kiln member 18 is supported for rotation such as by the provision of rollers 20 and 22 supported on posts 12 and 14. The kiln member 18 rotates about an axis coincident with the axis of the tubular structural member and at the same acute angle with respect to the horizontal support surface 16.

Concentrically received within the kiln member 18 is a tubular liner 24. The liner 24 is made of electrical and heat conducting material, such as steel or steel alloy, nichrome, tungsten, etc.

The tubular liner 24 may be positioned so that the external surface 24A thereof is contiguous with the kiln member internal tubular surface 18A, or, preferably as shown, a refractory packing 26 is employed which serves to insulate the tubular liner 24 from the kiln member 18. The refractory packing 26 may be of high temperature insulation material such as mineral wool, fiber glass and so forth. The refractory packing 26 may be in loose form and packed in the annular area between the tubular liner external surface 24A and the kiln member internal tubular surface 18A, or it may be in the form of an integral tubular element positioned between members 18 and 24. In either event, the function of the refractory packing 16 is to thermally insulate the tubular liner 24 from the kiln member 18 to thereby reduce the temperature to which the kiln member is subjected.

As previously indicated, the kiln member 18 is supported for rotation. This can be accomplished such as by means of a pulley 28 positioned concentrically on the exterior surface of the kiln member at one end thereof receiving a belt 30 driven by a second pulley 32 affixed to the shaft of a motor 34.

The interior of the kiln, that is, the internal tubular surface 24B is shown open at each end as in the means wherein the kilns are typically commercially utilized in which the raw materials to be reacted are inserted into the upmost end 36 and tumble and migrate and are discharged at the lower end 38. It can be seen, however, that if it is desirable to more carefully control the environment within the interior 24B of the tubular liner that the ends could be closed with openings only necessary to receive the input of materials and the discharge thereof and that with closed ends inert gas could be maintained within the interior of the kiln.

Surrounding the structural member 10 is an induction coil 40. In the illustrated arrangement the induction coil is formed by means of a copper tube which can be cool by the flow of water therethrough supplied by a chiller 42, the water flowing from the chiller by means of conduit 44 into one end 40A of the induction coil, the water being returned to the chiller by means of conduit 46 connected to the other end 40B of the induction coil.

High frequency electrical energy is supplied by an induction heater power plant 48 having one cable 50 connected to end 40A of the induction coil and another cable 52 connected to end 40 of the induction coil. When the induction coil 40 is energized by means of the power unit 48, kiln liner 36 is heated and the temperature of the liner can be very accurately controlled by control of the frequency and the current in the induction coil. In this manner the temperature to which reaction components within the kiln are subjected is much more easily controlled than with the standard rotary kiln in which heat is supplied by combustible fuel injected into the interior of the kiln. Further, by selecting the placement of the induction coil 40 the temperature of various areas within the kiln can be controlled. For instances, if it is desired that the kiln be of the same temperature, more or less throughout the length thereof, then coil 40 is equally spaced along the length; whereas, if it is desired that certain portions be at a higher temperature than other portions, the number of turns of the induction coil 40 can be concentrated in the portions wherein higher temperatures are desired and less concentrated in areas where lower temperatures are desired.

The invention thus provides an improved type of kiln having advantages over the existing internally fired kilns.

The claims and the specifications describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purpose of exemplification, but is to be limited only by the scope of the attached claim or claims, including the full range of equivalency to which each element thereof is entitled.

What is claimed is:

1. An improved rotary kiln comprising:

an elongated tubular kiln structural member formed of refractory material and supported for rotation;

a tubular liner in said kiln member formed of electrically conductive material;

a stationary tubular structural non-electrically conductive member concentrically surrounding said kiln member and of interior diameter greater than the exterior diameter of said kiln member providing an annular space therebetween;

an induction coil wound on the exterior of said structural member;

means to supply AC electrical energy to said induction coil; and means of rotating said kiln member.

2. An improved rotating kiln according to claim 1 including insulation packing of non-electrical conductive material between the exterior of said tubular electrically conductive liner and the interior of said tubular kiln member.

3. An improved rotary kiln according to claim 2 wherein said insulation packing of non-conductive material is selected from the group comprising mineral wool, fiber glass, ceramic fibers and mixtures thereof.

4. An improved rotary kiln according to claim 1 wherein said induction coil is formed by a coil of conductive tube and including means of circulating a cooling fluid through said tube.

5. An improved rotary kiln according to claim 1 wherein said electrically conductive tubular linear is of a material selected from the group comprising steel, nichrome steel, tungsten, nickel-chrome alloy and nickel-chrome-steel alloy.

6. An improved rotary kiln comprising:

a stationary elongated tubular non-electrically conductive structural member having an interior and exterior circumferential surface;

an elongated tubular kiln member formed of refractory material having an interior and an exterior cylindrical surface and supported concentrically within said stationary structural member and being of less external diameter than the internal diameter of said structural member providing an annular space therebetween;

a tubular liner of electrically conductive material positioned concentrically within said kiln member and having an internal and an external cylindrical surface, the external diameter being less than the internal diameter of said kiln member and providing an annular space therebetween;

an induction coil wound on said external cylindrical surface of said stationary structural member; and means of rotating said kiln member.

* * * * *